US005608442A

United States Patent [19]

Bennefeld et al.

[11] Patent Number: 5,608,442

[45] Date of Patent: Mar. 4, 1997

[54] HEATING CONTROL FOR THERMAL PRINTERS

[75] Inventors: David H. Bennefeld, Ramsey; Jonathan D. Elliot, St. Louis Park; Danny J. Vatland, Chanhassen; John M. Gilbert, Minneapolis, all of Minn.

[73] Assignee: Lasermaster Corporation, Eden Prairie, Minn.

[21] Appl. No.: 299,291

[22] Filed: Aug. 31, 1994

[51] Int. Cl.[6] ..... B41J 2/36

[52] U.S. Cl. ..... 347/211; 347/191

[58] Field of Search ..... 347/191, 211; 400/120.11

[56] References Cited

U.S. PATENT DOCUMENTS

| | | | |
|---|---|---|---|
| 4,262,188 | 4/1981 | Beach | 219/216 |
| 4,524,368 | 6/1985 | Inui et al. | 346/76 |
| 4,540,991 | 9/1985 | Kariya et al. | 346/76 PH |
| 4,573,058 | 2/1986 | Brooks | 346/76 PH |
| 4,758,966 | 7/1988 | Brooks et al. | 364/519 |
| 4,789,870 | 12/1988 | Lacord et al. | 346/1.1 |
| 5,089,831 | 2/1992 | Ito et al. | 346/76 PH |
| 5,109,235 | 4/1992 | Sasaki | 346/76 PH |
| 5,142,301 | 8/1992 | Matsumoto | 346/76 PH |
| 5,163,760 | 11/1992 | Nardozzi | 400/120 |
| 5,204,704 | 4/1993 | Genno et al. | 346/76 PH |
| 5,208,607 | 5/1993 | Ohashi et al. | 346/1.1 |
| 5,216,440 | 6/1993 | Aoyagi | 346/76 PH |
| 5,305,024 | 4/1994 | Moriguchi et al. | 346/140 |
| 5,365,257 | 11/1994 | Minowa et al. | 346/76 PH |

FOREIGN PATENT DOCUMENTS

| | | |
|---|---|---|
| 0421353A2 | 4/1991 | European Pat. Off. . |
| 0573923A2 | 12/1993 | European Pat. Off. . |
| 0601658A1 | 6/1994 | European Pat. Off. . |
| B41J2/315 | 10/1988 | Germany . |

*Primary Examiner*—Huan H. Tran
*Attorney, Agent, or Firm*—Kinney & Lange

[57] ABSTRACT

A thermal printer includes a thermal print head having a plurality of heating elements for printing dots. A source of drive pulses operates respective heating elements. Each drive pulse is modulated to provide first and second periods of the drive pulse to selectively energize the respective heating element, the first and second periods defining a selected energy level. A memory stores the modulated drive pulses and supplies respective modulated drive pulses to the respective heating elements. A measuring circuit measures a heating factor of each heating element and provides a correction factor for each heating element based on the respective measured heating factor. The correction factors are combined to the respective drive pulses to alter the first and second periods, thereby reducing variations in dots due to differences in the heating factors of the heating elements.

32 Claims, 4 Drawing Sheets

HEATING CONTROL FOR THERMAL PRINTERS

BACKGROUND OF THE INVENTION

This invention relates to controls for thermal printers, and particularly to controlling the drive current supplied to heating elements of a thermal printer.

Thermal printers employ thermal energy to form images on a media. Broadly, such printers operate by either applying thermal energy to the media to alter image characteristics of the media, or by thermally energizing a hot melt wax ink ribbon to transfer ink to the media. These printers are characterized by stationary heads that extend across the width of the media and have heating elements for each pixel location on the media. The number of heating elements is dependant on the resolution of the printer (number of dots per inch, or dpi, along each line of print) and the width of the printer carriage. Thermal printers usually have a large number of heating elements, often numbered in the thousands.

The picture elements (pixels) formed on the media may be binary elements (full tone or no tone) whose size is, in part, dependent upon the amount of heat applied by the corresponding heating element. Alternatively, the pixels formed on the media may be contone elements (gradation over a range from no tone to full tone) whose intensity is, in part, dependent upon the amount of heat applied by the corresponding heating element. In either case, the amount of heat applied by a heating element is, in part, dependent upon the amount of drive current supplied to the heating element, the resistance value of the heating element, the ambient temperature of that heating element at the start of the current cycle, and the temperature of neighboring heating elements. Most thermal printers employ controls to overcome or at least reduce the effects due to heat generated by neighboring heating elements.

In U.S. Pat. No. 5,519,426 issued May 21, 1996 and co-pending application Ser. No. 08/298,936, filed Aug. 31, 1994 for "Method and Apparatus for Controlling a Thermal Print Head" by Lawrence J. Lukis, J. Mark Gilbert and Danny J. Vatland and assigned to the same assignee as the present invention, there is described a technique for developing thermal image data to control internal switches to the heating elements of a thermal print head to thereby control the application of drive current to the thermal print head. The Lukis et al. application describes the generation of drive current signals for the heating elements of a head to generate a requisite binary image size by the selected heating element, while taking into account the ambient temperature of the heating elements and thermal interaction between adjacent heating elements. In a preferred form of the invention described in the Lukis et al. application, the drive currents are right or end justified so that they terminate simultaneously, but the start times for the current pulses vary depending on the length of time that the particular element is to be energized.

It is known that tolerances in the manufacture of thermal print heads (including those for thermally driven ink jet printers) result in resistance values of the elements that vary as much as ±15%. Moreover, in use, the heating elements may thermally degrade, thereby altering (usually increasing) the resistance values of the heating elements. Thus, the range of resistance values of the heating elements may be 30% or more, depending on manufacturing tolerances and the manner in which the various heating elements degrade. Thermal degradation usually increases the resistance value so that the heating element generates less heat for a given quantity of applied voltage, thereby deteriorating the quality of the print image and shortening head life. Thus, the print head may generate dots that are smaller (in binary printing) or less intense (in contone printing) than intended. Consequently, it is common to employ compensation techniques to compensate for differences in resistance values, particularly due to manufacturing tolerances.

The resistances of the heating elements are usually measured as a function of the load current of the elements. However, leakage current in the thermal head interferes with accurate measurement of the load current of a given heating element, thereby making resistance measurement inaccurate.

SUMMARY OF THE INVENTION

In a first aspect of the invention, a thermal printer includes a print head having a plurality of heating elements for printing dots. A source of drive pulses operates respective heating elements so that the respective heating element is energized during a first portion of the drive pulse and not energized during a second portion of the drive pulse. A measuring circuit measures a heating factor of each heating element, and a memory stores a correction factor for each heating element based on the respective measured heating factor. The correction factors are used to adjust the respective drive pulses to alter the first and second periods to reduce variations in dot size due to differences in the heating factors of the heating elements.

In a second aspect of the invention, a thermal printer includes a print head having a plurality of heating elements for printing dots. A source of drive pulses operates respective heating elements, each drive pulse being modulated to provide a first period of the drive pulse during which the respective heating element is energized and a second period of the drive pulse during which the respective heating element is not energized. The first and second periods define a selected energization level. A memory stores the modulated drive pulses. The memory is connected to the heating elements to supply respective modulated drive pulses to the respective heating elements.

In this second aspect of the invention, the printer may optionally include a measuring circuit for measuring a heating factor of each heating element. A memory stores a correction factor for each heating element based on the respective measured heating factor. The correction factors are used to adjust the respective drive pulses to alter the first and second periods to reduce variations in dot characteristics due to differences in the heating factors of the heating elements. The memory storing the correction factor may be the same memory that stores the modulated drive pulses, or it may be a separate memory.

In accordance with yet another aspect of the invention, measurement apparatus measures the resistance of a selected heating element. The measurement apparatus includes a charge storage device, such as a capacitor. A first charge circuit charges the charge storage device with a charge representative of the leakage current of all of the heating elements. A second charge circuit provides a signal to the charge storage device representative of the load current of the selected heating element and the leakage current of all of the heating elements. An output circuit connected to the charge storage device provides an output signal representative of the load current.

In accordance with yet another aspect of the present invention, the resistance of a selected heating element of a thermal print head is measured by disconnecting the thermal print head from the power source. A measuring circuit having a charge storage device is connected to the thermal print head. A source of measurement voltage is supplied to the thermal print head while not operating the selected heating element to thereby charge the charge storage device with a charge representative of the measurement voltage and leakage current of the thermal print head. Then the selected heating element is operated with the source of measurement voltage to change the voltage on the charge storage device by an amount representative of the load current of the selected heating element. A signal representative of the change of voltage on the charge storage device is output, such as to a memory table.

In accordance with yet another aspect of the present invention, a thermal printer has a thermal prim head having a plurality of resistive heating elements and a power supply for supplying a load current to the heating elements. A switch selectively connects the power supply to the thermal print head. A measuring circuit provides a measurement signal and has an output connected to the thermal print head to provide the measurement signal to the thermal print head. The measuring circuit includes means for preventing the signal circuit from sinking current from the power supply when the switch connects the power supply to the thermal print head. A sense circuit is connected to the signal circuit to measure the current through the thermal print head when the switch disconnects the power supply from the thermal print head.

DETAILED DESCRIPTION OF THE PREFERRED EMBODIMENTS

Figure 1:
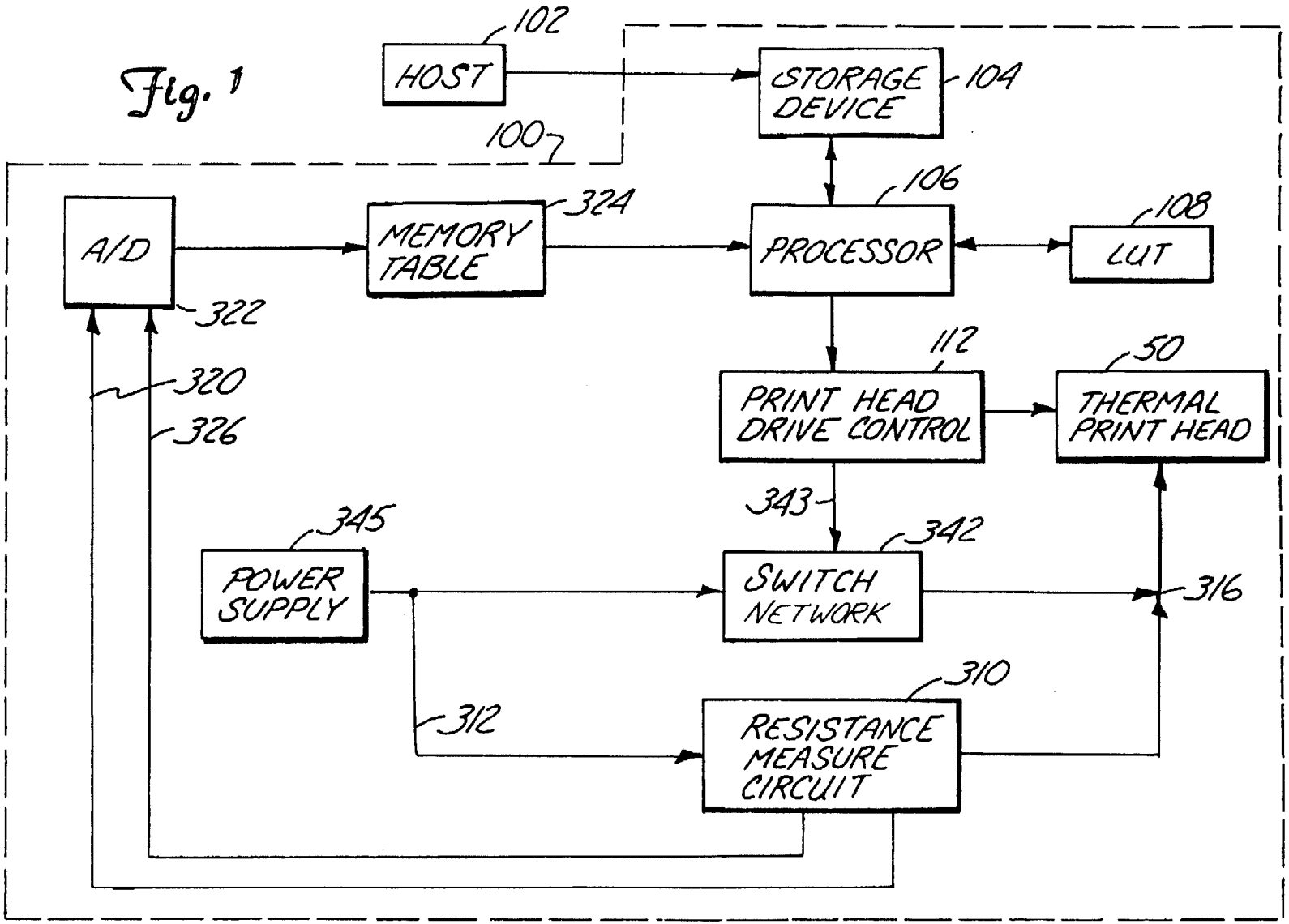
FIG. 1 is a block diagram of a thermal printer.

FIG. 1 is a block diagram of a control system 100 for driving the heating elements of a thermal printing head 50 of a thermal printer. The printer may be of the type employing a media that changes image characteristics in the presence of heat or may be one employing a hot melt wax ink ribbon to transfer ink to the media. Host 102 is a computer or other processor having one or more software applications executing thereon for generating source image data. Alternatively, host 102 may be a conventional imaging device such as a video camera or scanner. Images from host 102 are transferred to storage device 104, such as a magnetic disc drive. Storage device 104 receives a grayscale rendering of the source image as a series of regularly spaced tones ranging from no tone to full tone through intermediate shades of gray. Alternatively, an interpreter can be provided to convert the source image into a grayscale image which is stored in storage device 104. Processor 106 receives the grayscale image data from storage device 104 to provide suitable drive control signals to print head drive control 112. Processor 106 uses look-up table 108 to generate the drive energies or drive levels for each heating element in thermal print head 50. These drive signals are provided to print head drive control 112 which processes the drive signals to provide gate signals representative of the drive energies to each heating element of thermal print head 50. Processor 106 uses digitally converted resistance measurement data stored in memory table 324 to modify the drive current pulses in accordance with resistance compensation data to develop the final drive current pulse signal for each heating element.

Print head drive control 112 provides gate signals or drive signals to switches (not shown) internal in thermal print head 50 to connect selected ones of the heating elements of thermal print head 50 to node 316. Power supply 345 is connected through switch network 342 to node 316. Switch network 342 is controlled through node 343 from print head drive control 112 for purposes explained below. The switches of thermal print head 50 operate in a manner well known in the art and under control of drive signals from print head drive control 112 to connect respective heating elements to node 316, and (in the operating mode) to power supply 345 to thereby energize the respective heating elements. Resistance measuring circuit 310 has an output connected to node 316 to measure the resistance of a heating element under test. Resistance measuring circuit 310 also has outputs connected via nodes 320 and 326 to analog-to-digital converter (A/D) 322 to provided digitally converted resistance measurement data to memory table 324. Resistance measuring circuit 310 is powered by power supply 345 via node 312.

In one preferred embodiment, the details of processor 106, storage device 104, and look-up table 108 are described in the aforementioned Lukis et al. application, which is incorporated herein by reference. Reference should be made to the disclosure of that application for a full understanding of the generation of the drive control signal that is input to print head drive control 112. The details of the print head drive control 112 and resistance measuring circuit 310, together with the relationships to switch network 342, power supply 345, A/D converter 322 and memory table 324, are described below. However, it is useful to first understand the nature of the drive control signals input to print head drive control 112.

The present invention will be described in connection with binary printing, namely printing dots having tone or no tone and whose size and placement create binary output images of a source image having improved fidelity. The size of a dot is dependent on the amount of energy forming the dot, which in turn is affected by the amount of drive current to the heating element, the thermal characteristics of the heating element and the effects of the temperature of neighboring heating elements.

In the apparatus described in the aforementioned Lukis et al. application, the drive signals to the heating elements are preferably right or end justified, meaning that they commence energizing the respective heating elements at various times during the duty or heating cycle of the drive signal (based on the amount of energy to be applied to the heating element), but the drive signals all terminate at the same time at the end of the cycle. While the invention will be described in connection with right or end justified signals, as in the Lukis et al. application, the invention is equally applicable to other forms of binary printing, such as printing using drive signals that are left or start justified as in the prior art, or using drive signals that overlap or not in accordance with other relationships. Moreover, the invention is also applicable to halftone printing where an illusion of tone is created by dot position and/or size as well as to contone printing where tone is created by dot intensity.

The drive signals described in the Lukis et al. application are drive pulses that can be modulated into consecutive time periods (100 such time periods being one preferred embodiment), apportioned as a series of binary ones and zeros. Hence, the drive signal comprises a series of 100 bits. With binary zero representing the "off" condition of energizing a heating element, a typical duty or heating cycle for a given heating element is represented by a drive signal of 100 bits commencing with binary zeros and changing to binary ones at some point during the series of 100 bits. Thus, a drive signal having an energization level of 50% would have 50 binary zeros followed by 50 binary ones, whereas a drive signal having an energization level of 20% would have 80 binary zeros followed by 20 binary ones. The duty cycles of the drive signals are of fixed duration.

Figure 2:
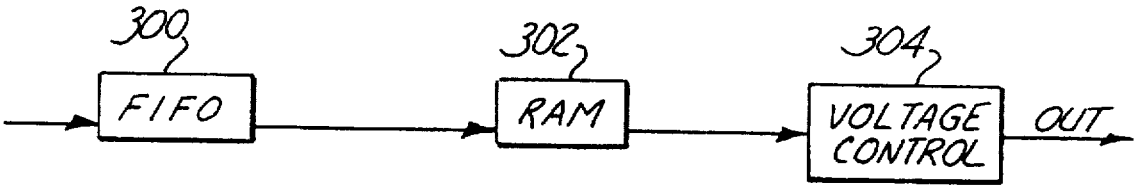
FIG. 2 is a block diagram of a print head drive control according to the present invention.

FIG. 2 is a block diagram of the print head drive control 112 according to the present invention. The print head drive control includes a first in-first out (FIFO) register 300 having its input connected to the output of processor 106 (FIG. 1) and its output connected to the input of random access memory (RAM) 302. The output of RAM 302 is input to voltage control circuit 304 whose output is connected directly to each of the switches (not shown) internal in the thermal print head used to apply current from power supply 345 (FIG. 1) to each of the respective heating elements of thermal print head 50 of the thermal printer.

As explained above, the drive pulses applied to the heating elements have various energization periods during which current is supplied to the respective heating element to effect an image. The size of a given dot at a given position on the media will be dependent on the drive current supplied to the heating elements adjacent and surrounding the dot position, and hence the energization period of the respective heating elements. Also as explained above, the modulation of the drive signal for each heating element is determined by processor 106, for example to 100 separate segments, or passes, representative of the energy to be supplied to the heating element for a given line. The 100 passes or segments each consist of a binary signal representing the energy level to be supplied to the heating element for that pass. For reasons explained in the aforementioned Lukis et al. application, the period of energization is preferably at the end of the duty cycle (or pulse cycle) of the drive signal so that the start time for the energization of the heating element (initial energization pass) will vary based on the amount of the duty cycle dedicated to driving the heating element. Nevertheless, the end of the energization is coincident for all heating elements with the end of the duty cycle. The duty cycle is thus divided into two periods, a first period of binary zeros during which the respective heating element is not energized followed by a second period of binary ones during which the respective heating element is energized. Voltage control circuit 304 operates the internal switches of the heating elements of the thermal print head for periods of time during the duty cycle as directed by the data in RAM 302.

Figure 3:
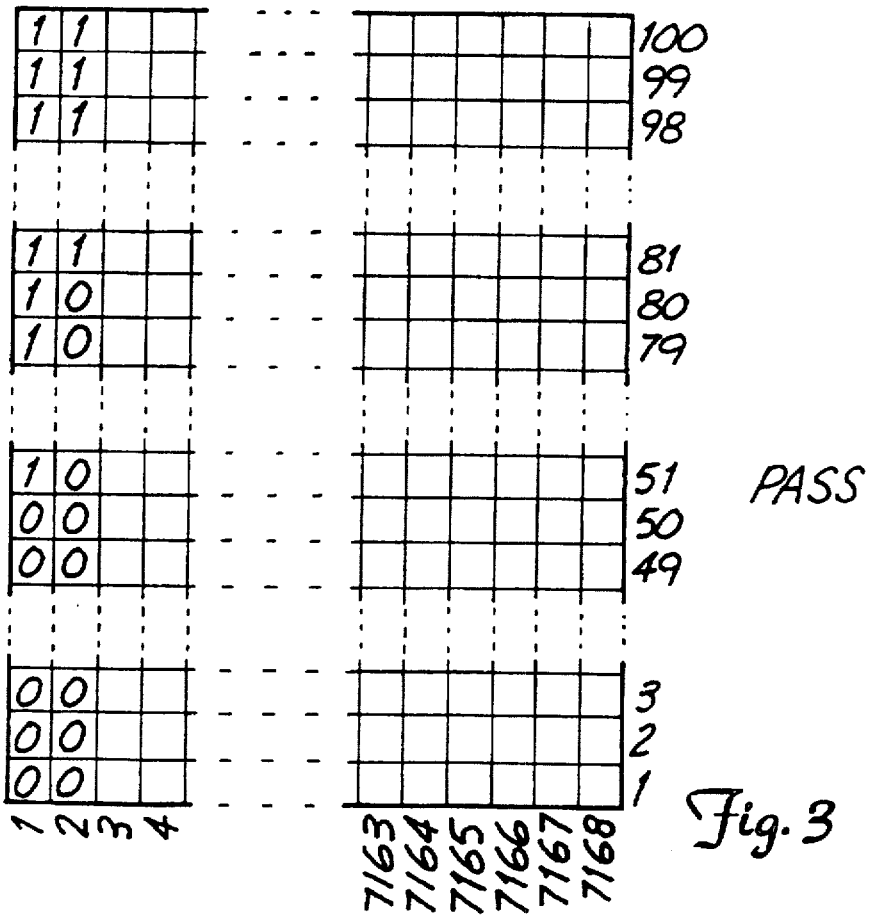
FIGS. 3 is a diagram of a representation of an arrangement of data in a memory that is useful in explaining the memory organization.

In the preferred form of the invention, the head contains 7168 heating elements spaced at a distance of 600 heating elements per inch (600 dpi) over a 303 mm.( 11.95 inches) width of the head. Preferably, the duty cycle of each signal pulse is 5 millisecs. FIG. 3 shows a table having a bit value for each of the 100 passes or segments of the drive signal for each of the 7168 heating elements. Thus, the horizontal axis of FIG. 3 identifies the heating element and the vertical axis identifies the pass or division number in the 5 millisec. duty cycle for the heating elements.

For example, consider a first heating element to be energized "on" or high during 50% of the 5 millisec. duty cycle and a second heating element to be energized "on" or high during 20% of the 5 millisec. duty cycle. In accordance with the present invention, control of the on or energization period of the drive signal pulse duty cycle is performed by modulating the drive signal pulse and selectively operating the drive pulse to on or high during selected modulation periods or divisions. During the first pass both of the heating elements are off (binary zero in the table). Hence, the drive signal to the heating elements is low. During the second pass the binary zero again indicates an off condition and low drive signal to both of the heating elements. At the fifty-first pass, the value of the drive signal for the first heating element becomes binary one (and continues to be one through the one-hundredth pass), whereas the value of the drive signal for the second heating element remains at binary zero. The second heating element is not energized until pass 81. Hence, the first heating element has zero value in table of FIG. 3 for passes 1 through 50 and a one value for passes 51 through 100, whereas the second heating element has a zero value for passes 1 through 80 and a one value for passes 81 through 100. Voltage control circuit 304 responds to a zero bit value in the table of FIG. 3 to produce a low or zero drive signal to the respective heating element and responds to a one bit value to deliver a high or non-zero current value to the respective heating element.

Figure 4:
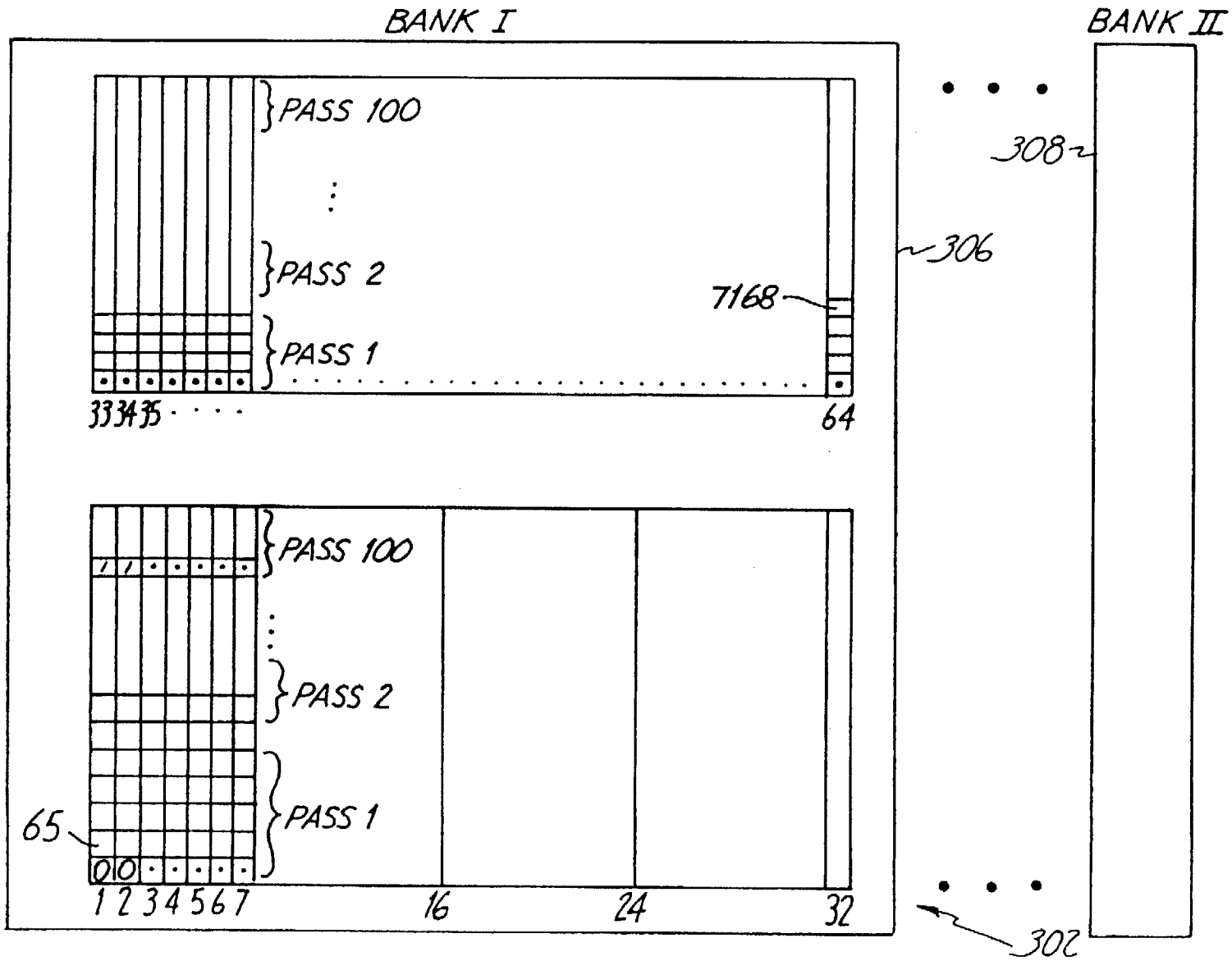
FIG. 4 is a diagram illustrating the organization of a memory used in the print head drive control of the present invention.

It will be appreciated that the table of FIG. 3 is actually implemented in RAM 302, the organization of which is shown in FIG. 4. RAM 302 includes a pair of banks 306 and 308 each capable of storing at least 716,800 bits (about 90K bytes), each byte containing 8 bits representing the energization value for the drive signal for eight of the heating elements of the thermal print head during a single pass. Thus, for the 7168 heating elements, 896 bytes of data are required for each pass. For a heating cycle of 5 millisec., each pass of 896 bytes of data operates the respective 7168 heating elements for 50 μsecs.

The second bank 308 of the RAM memory is identical to first bank 306 and is operable to store data for all 100 passes for all 7168 heating elements. Thus, each bank 306 and 308 contains data for operating the heating elements for an entire line of data. One feature in separating the banks in the manner described is that as data are read from one bank to voltage control circuit 304 (FIG. 2), data are loaded into the other bank for the next line. Thus, one bank operates to create drive signals to print one line of data, while the other bank simultaneously operates to load data for the next line to be printed.

Voltage control circuit 304 (FIG. 2) responds to the binary values of the data for each pass to generate either a binary one or zero drive signal to the respective heating element switch based on the binary value of the data in the corresponding location in the RAM. If voltage control circuit 304 generates a binary one drive signal to the respective heating element switch, then the heating element switch is set conductive allowing current to flow through the respective heating element from power supply 345 (FIG. 1) or resistance measurement circuit 310, depending on the condition of switch network 342. Conversely, if the voltage control circuit 304 generates a binary zero drive signal, then the respective heating element switch is opened, and current flow through the respective heating element is disabled.

In the present invention, the drive signal pulses are modulated to provide a first period of the drive pulse during which the respective heating element is not energized and a second period of the drive signal pulse during which the respective heating element is energized. The first and second periods define a selected energization level to select the desired dot size. RAM 302 stores the modulated drive signal pulses for the heating elements. The RAM does not introduce the expense or delays associated with shift registers and counters, as in the prior art. RAM 302 supplies drive signal pulses to voltage control 304 to operate the respective heating element switches.

Figure 5:
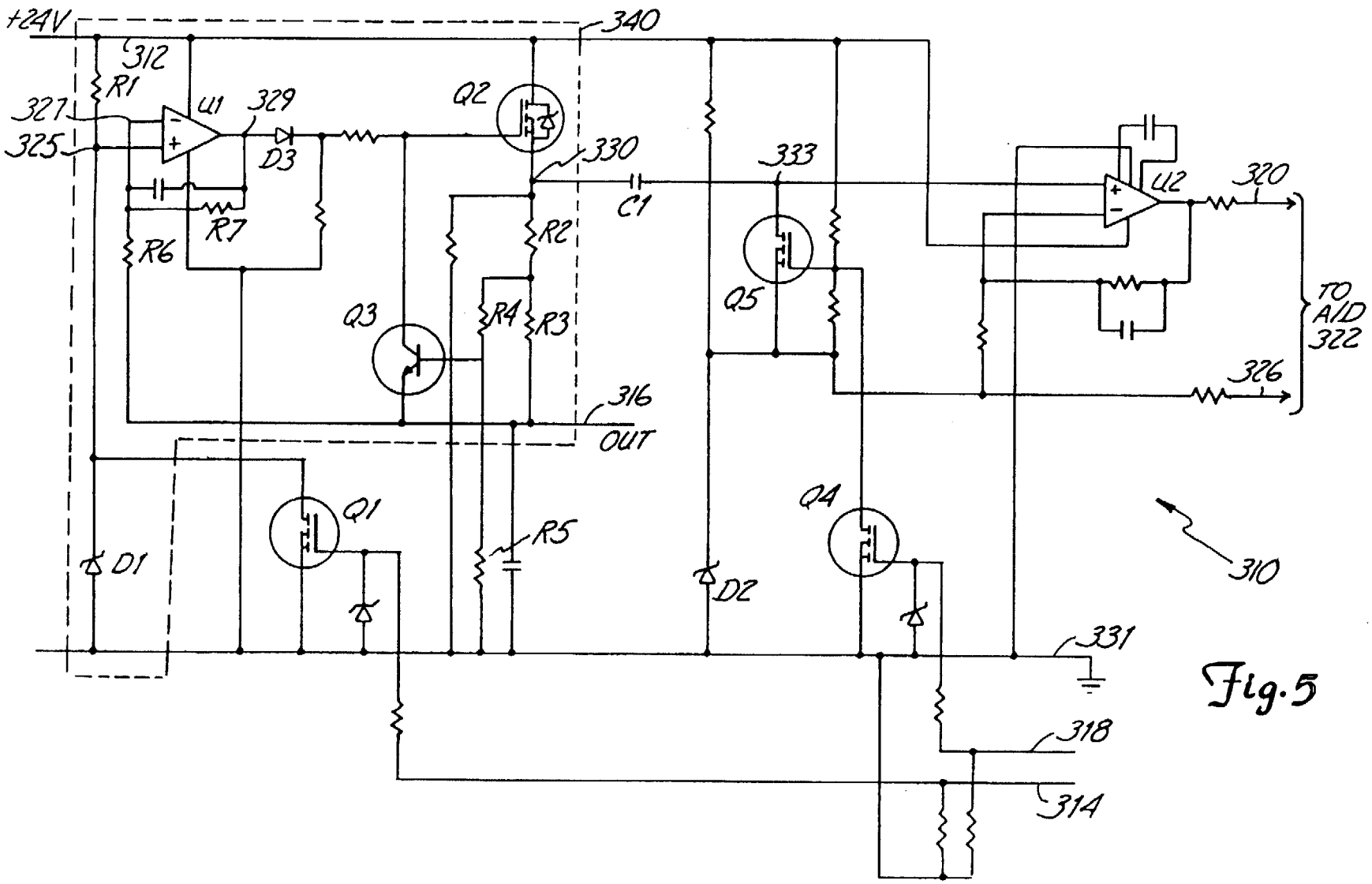
FIG. 5 is a circuit diagram of a resistance measuring circuit for measuring the resistance values of the heating elements of a thermal print head.

One problem common to thermal primers resides in the fact that the resistance values of the heating elements of thermal print heads often vary over time and can vary as much as ±15%. Moreover, the resistance values usually increase over time affecting the performance of the head. One aspect of the present invention is to compensate for differences in resistance values due to manufacturing variances as well as heating element deterioration. This is accomplished by periodically measuring the heating factor or resistance value of each heating element, storing a digital representation of a compensation value or correction factor based on the measured heating factor or resistance value in memory table 324 shown in FIG. 1, and altering the duration of the on or high time of the heating cycle by an amount based on the compensation value or correction factor. FIG. 5 is a circuit diagram of a resistance measuring circuit 310 to measure the heating value or resistance value of the heating elements of the head.

Measuring circuits measure the resistance difference between heating elements by measuring and comparing the load currents of each heating element. However, leakage current can affect the measurement, especially where the leakage current is a significant amount due to a large number of heating elements. Leakage current through a heating element can be as much as 10 microamps. In the present invention employing a thermal print head having 7168 heating elements, the leakage can be as much as 72 milliamps across the entire head. During normal operating conditions, each heating element will draw about 4.5 milliamps. Thus, the measuring circuit must measure a 4.5 milliamp load current in the presence of a 72 milliamp leakage current. Where the measurement voltage to the thermal print head is designed to produce a 4.5 milliamp load current, it is not possible to accurately measure variations of one or two tenths of a milliamp or less in the presence of a 72 milliamp leakage current using conventional measuring circuits. FIG. 5 illustrates a resistance measuring circuit 310 according to the present invention to provide accurate measurement of the relative load currents through the heating elements.

Power supply 345 (FIG. 1) provides a regulated 24 volt supply through switch network 342 (FIG. 1) to node 316 (FIGS. 1 and 5). The conductive condition of switch network 342 is established by a logic signal at node 343 from print head drive control 112, as explained below. Resistor R1 (FIG. 5) is connected through a reference voltage source to ground. The reference voltage source, provided by Zener diode D1, is shunted by FET Q1 whose conductive condition is controlled by a logic signal at node 314. When conducting, FET Q1 pulls the non-inverting input 325 of amplifier U1 to ground, whereas when non-conducting, FET Q1 does not shunt Zener diode D1 and Zener diode D1 provides a reference voltage to the non-inverting input 325 of amplifier U1. The reference voltage provided to the non-inverting input of amplifier U1 is equivalent to the specified Zener voltage of Zener diode D1. In a preferred embodiment, the Zener voltage of Zener diode D1 is 12 volts.

Voltage regulator circuit 340 operates as a closed loop system that includes amplifier U1, Zener diode D1, diode D3, FET Q2 and resistors R2, R3, R6 and R7. When the non-inverting input of amplifier U1 at node 325 is grounded, amplifier U1 operates through diode D1 to provide essentially a zero volt signal to the gate of FET Q2 to turn off FET Q2. When a reference voltage, such as 12 volts, is applied to the non-inverting input of amplifier U1 at node 325, the output voltage of amplifier U1 is provided at node 329 to drive the gate of FET Q2 to regulate the voltage at node 327 to a value equal to the reference voltage at node 325. Negligible current flows through resistor R6 and the voltage at node 316 is equal to the voltage at node 327.

In the operation mode, print head drive control 112 (FIG. 1) provides a logic signal on node 343 to operate switch network 342 to provide power from power supply 345 to node 316 and thermal print head 50. For example, switch network 342 may be a bank of parallel power transistor switches designed to carry the high current (e.g., 30 amps) necessary to power the 7168 heating elements of the thermal print head. It is preferred that the input signal on node 314 (FIG. 5) is a logic high to operate FET Q1 into conduction to ground non-inverting input 325 of amplifier U1 and drive FET Q2 non-conductive. Nevertheless, FET Q2 will have no voltage across it during printing due to the presence of the 24 volt supply at node 316. Moreover, diode D3 ensures that the voltage regulator circuit 340 is unipolar so that the circuit cannot sink current and can only source current. Hence, measurement circuit 310 does not interfere with the print operation during the operating mode and cannot suffer damage from the 24 volt supply during printing even though connected to thermal print head 50.

During operation, power supply 345 provides 24 volt power to the heating elements of thermal print head 50 as selectively operated under control of the drive signals from print head drive control 112, all as previously discussed.

When it is desired to measure the resistance of the heating elements, print head drive control 112 (FIG. 1) changes the status of the logic signal at node 343 to operate switch network 342 to a non-conducting state, thereby removing power supply 345 from connection to node 316 and thermal print head 50.

In the measurement mode, the input signal at node 318 (FIG. 5) is initially set logically low, thereby forcing FET Q4 into non-conduction to force FET Q5 into conduction. Zener voltage reference diode D2 provides a reference voltage through FET Q5 to node 333 on one side of storage capacitor C1. The reference voltage provided to node 333 is equivalent to the specified Zener voltage of Zener diode D2. In a preferred embodiment, the Zener voltage of Zener diode D2 is 1.2 volts.

Next, the input signal at node 314 is set to a logic low, thereby operating FET Q1 into non-conduction and removing the shunt from diode D1. As a result, a 12 volt reference signal is imposed onto the non-inverting input of amplifier U1. Amplifier U1 and FET Q2 form a linear regulator with resistors R2 and R3 (whose combined resistance is 100.0Ω), with the feedback through the inverting input of amplifier U1 to regulate the output at node 316 to a value equal to the Zener diode D1 voltage drop (e.g., 12 volts). Zener diode D2 continues to provide a regulated 1.2 volt source to one side (node 333) of capacitor C1. The other side of capacitor C1 is connected to node 330. The voltage at node 330 is equal to the voltage at node 316 plus whatever voltage appears across resistors R2 and R3. At this time, the voltage across resistors R2 and R3 is directly proportional to the total leakage current of the thermal print head.

With the 12 volt supply at node 316 provided by Zener diode D1 and voltage regulator circuit 340, current will flow through head 50 in the form of leakage current through all of the heating elements of thermal print head 50. Normally total leakage current with a 24 volt supply is as much as 72 milliamps. With a 12 volt supply, leakage current will be as much as about 36 milliamps and will appear across the 100 ohm sensing resistance formed by resistors R2 and R3. As an example, if the leakage current is 30 milliamps, the voltage drop across resistors R2 and R3 will be 3.0 volts. Hence, the total voltage at node 330 will be about 15.0 volts (depending on the exact level of the reference voltage). The voltage across capacitor C1 equals the difference between the voltages at nodes 330 and 333, or 13.8 volts.

Next, the reset signal on node 318 is set to a logic high to turn on FET Q4 and turn off FET Q5. Turning off FET Q5 effectively removes capacitor C1 from the 1.2 volt reference voltage provided by Zener diode D2. Therefore little current (of the order of a few nanoamps) will flow through capacitor C1 to amplifier U2.

Next, the heating element under test is operated by the 12 volt supply at node 316. This is accomplished by operating RAM 302 and voltage control 304 (FIG. 2) to control the internal switches in the heating elements of thermal print head 50 (FIG. 1) to drive only the single heating element under test with the measurement voltage at node 316. With the 12 volts supply applied to the heating element under test connected between node 316 and circuit ground node 331, the load current through the heating element (which would be normally about 2.25milliamps, or one half of the 4.5 milliamp draw at 24 volts), together with the leakage current for all heating elements, will pass through the 100 ohm resistance of resistors R2 and R3 to change the voltage at node 330 by an amount representative of the load current of the heating element under test. More particularly, if the load current of the heating element under test is 2.25 milliamps, the voltage at node 330 becomes equal to the voltage at node 316 (12.0 volts), plus the voltage across resistors R2 and R3 due to the load current (0.225 volts), plus the voltage across resistors R2 and R3 due to the leakage current (3.0 volts), for a total voltage of 15.225 volts. However, the voltage across capacitor C1 (13.8 volts) does not change, so the voltage at node 333 also increases by an amount equal to the voltage due to the load current across resistors R2 and R3 to be equal to the voltage due to the load current plus the reference voltage of Zener diode D2 (1.425 volts in the example). This voltage is provided as an input to the non-inverting input of amplifier U2. Since the reference voltage from Zener diode D2 (e.g., 1.2 volts) is also provided to the inverting input of amplifier U2, the amplifier amplifies the difference between the signals at its inputs (0.225 volts). In a preferred embodiment, amplifier U2 has a gain of 10; hence, amplifier U2 produces a 2.25 volt change in its output voltage at node 320 (from the 1.2 volt reference to 3.45 volts).

The regulated voltage provided by Zener diode D2 (e.g., 1.2 volts) is also provided to node 326. As shown in FIG. 1, the difference between the output voltages at nodes 320 and 326 (2.25 volts in the example) is processed by A/D converter 322 to derive a digital representation of the heating value of the heating element under test in the thermal print head. The digital representation of resistance values is stored in memory table 324 for later use.

The amount that the voltage on node 320 differs from the voltage at node 326 is indicative of the resistance, and hence the heating factor, of the respective heating element. The voltage at node 326 is essentially equal to the specified Zener voltage of Zener diode D2. In the present invention, the specified Zener voltage of diode D2 is 1.2 volts. Consequently, performing an analog-to-digital conversion on the voltage difference between nodes 320 and 326 permits determination of the resistance values of each heating element in the thermal print head. A/D converter 322 (FIG. 1) may employ a lookup table to compare the digitized difference values between the voltage at nodes 320 and 326 and derive a correction factor to be stored in memory table 324 to be combined with image data to modify the drive signals to thermal print head 50.

Resistance measuring circuit 310 is operated by turning off the 24 volt power to the heating elements of thermal print head 50. Resistance measuring circuit 310 is operated by first operating switch network 342 to remove the 24 volt supply to the heating elements in thermal print head 50. Measuring circuit 310 is then activated by impressing a logic low signal on node 314 to provide a constant 12 volt output at node 316 to thermal print head 50.

The signal at node 318 is set to a logic low level to charge capacitor C1 to the voltage difference between node 330 (which now represents the leakage current of the thermal print head) and node 333 (which is the reference voltage established by Zener diode D2). This action effectively initializes the voltage at node 333 and across capacitor C1 in preparation for the actual measurement. After a short time to permit charging of capacitor C1 (approximately 300 microsecs in the preferred embodiment), node 318 is set to a logic high to force FET Q5 non-conductive and eliminate the charging path for capacitor C1. The heating element under test is then turned on by print head drive control 112 (FIG. 1) and is operated under the 12 volt measurement signal at node 316. Since the voltage across capacitor C1 cannot change, the voltage representation of the load current in the heating element under test is impressed directly on the non-inverting input of amplifier U2, which is amplified and then processed by A/D converter 322. Print head drive control is then operated to shut off the heating element, and the cycle is repeated for each heater element whose resistance is to be measured, commencing with the setting of the signal at node 318 to a logic low.

The resulting signals from resistance measuring circuit 310 for each test iteration are processed through A/D converter 322 for storage in memory table 324 (or RAM 302, as explained below). Measuring circuit 310 may be activated by processor 106 (FIG. 1) each time the printer is activated (such as at the beginning of each print job) or at some other convenient time. In the present invention, the resistance measurement for each heating element is performed in about 10 millisecs., so the total time for the measurement of all 7168 heating elements of the entire head is accomplished in about 1¼ minutes.

There is a time delay between turning on the heating element under test and initializing the A/D converter to begin the conversion process to permit the voltage at node 320 to stabilize.

One feature of resistance measuring circuit 310 shown in FIG. 5 is that during the operation mode, node 316, connected to the thermal print head, is also connected to the 24 volt supply through switch 342. However, measuring circuit 310 cannot be damaged by the 24 volt supply appearing at node 316 during the operation mode and will not interfere with operation by virtue of node 316 being forced to the 24 volt supply by switch network 342. This is a result of nodes 312 and 316 being common to both the measuring circuit 310 and the switch network 342 so there is no voltage across FET Q2 when the printer is in the operating mode, and a result of voltage regulator circuit 340 being unipolar so that it cannot sink current, only source current. This permits large currents (e.g., up to 30 amps) to be delivered to the thermal print head without passing through the measuring circuit 310 and permits permanent connection of the measuring circuit to the thermal print head. Another feature of the invention is that operation of FET Q5 places the 1.2 reference voltage on the non-inverting input of amplifier U2 to maintain that amplifier active. The 1.2 reference voltage is also output at node 326 to A/D converter 322 (FIG. 6). This permits the A/D converter to convert the difference voltage between nodes 320 and 326 to compensate for common mode noise.

It will be appreciated by those skilled in the art that the resistance measuring circuit of FIG. 5 is applicable to thermal printers that print by applying thermal energy to the media or to an ink wax ribbon, as well as to ink jet printers that use thermal energy to excite an ink supply to discharge droplets of ink toward a media.

The heat energy supplied to a selected heating element is proportional to the time that a drive voltage is applied to the heating element and inversely proportional to the resistance of the heating element. If a heating element is determined by the resistance measuring circuit to have a resistance value 10% above average, the time that the drive voltage is applied must be increased by 10% to supply the same total energy to the selected heating element during a particular duty cycle. This can be accomplished by operating processor 106 to multiply the drive signal duration by a multiplicative factor stored in memory table 324. For example, a drive signal having an energization level of 50%, destined for a heating element with a 10% higher than average resistance, would be adjusted by processor 106 to an energization level of 55%.

Scaling the energization time of each drive signal by a multiplicative factor can produce an undesirable load on processor 106. Therefore, another embodiment of the present invention reduces the load on the processor by storing an additive adjustment value for each heating element in memory table 324, the additive adjustment value being added by processor 106 to the drive signal for each heating element. The additive adjustment value approximates the multiplication scaling factor with sufficient accuracy over a useful range of energization levels. In the previous example, a heating element with a 10% above average resistance might have an additive adjustment value of 5 stored in memory table 324. In this case, the 50% energization level would be correctly increased from 50% to 55%. Other energization levels will also be increased by the same amount, resulting in small inaccuracies. (A 40% energization level, for example, would be increased to 45% instead of 44%.)

To further reduce the load on processor 106 resulting from drive energization level correction, the additive adjustment values from memory table may be written directly into RAM 302 with little or no action on the part of processor 106.

As previously described and illustrated particularly in FIG. 3, it is preferred that the heating element be energized or "on" during the end of the heating cycle, rather than the beginning. This produces the desirable effects in dealing with hysteresis and in improving the quality of the ultimate image as described above. Energization during the trailing portion of the drive pulse is accomplished by writing the correction factor and image energization data into the highest pass positions for each heating element, and setting the lowest remaining pass positions to a 0 energization level. Thus, heating element correction factors may be written into RAM 302 commencing with the highest pass position (100) and working backwards. Data dealing with the specific image are then read into RAM 302 commencing with the pass position from where the correction factor left off. Using the example of FIG. 3, if bit position 1 requires a correction factor of 10, the positions of passes 91 through 100 are written with ones. Then, since the image data requires a 50% signal to be applied to the first element, ones are written into the positions of passes 41 through 90, leaving the positions of passes 1–40 at zero. Hence, the correction data is concatenated with the image data.

In the form of the invention shown in FIG. 1, the correction factor is stored in memory table 324 and is transferred to RAM 302 via processor 106 and FIFO 300 for concatenation with the image data. This permits the processor to employ memory table 324 as a lookup table that provides correction data to the input image data. Moreover, if the image data for a given pixel requires the heating element to not be energized during any of the 100 passes, it may be desirable not to insert the correction factor into RAM 302 for that particular element. This is accomplished by simply testing the value of the image for the heating element which, if all zeros, generates an inhibit of the transfer of the correction factor from memory 324 into memory 302.

Alternatively, the correction factors may be simply stored in the highest pass positions of RAM 302 and the image data merely concatenated in RAM 302 to the correction data. This approach may result in a savings of computer memory and processing. Since the values of the compensation factors are not likely to reach the threshold heating level of the respective heating elements, there is little likelihood that the compensation factor could affect the image.

In any case, the correction factors are combined with the input image data to derive drive signals for the thermal print head that are adjusted for resistance variations of the heating elements.

The present invention thus provides a source of drive pulse signals for operating respective heating elements. Each drive pulse operates to not energize the respective heating element during a first portion of the drive pulse and to energize the respective heating element during a second portion of the drive pulse. The measuring circuit measures a heating factor of each heating element and a memory stores a correction factor for each heating element based on the respective measured heating factor. The correction factors are used to adjust the respective drive pulses to alter the first and second periods to reduce variations in dot size due to differences in the heating factors of the heating elements.

Although the present invention has been described with reference to preferred embodiments, workers skilled in the art will recognize that changes may be made in form and detail without departing from the spirit and scope of the invention.

What is claimed is:

1. A thermal printer comprising:

a thermal print head having a plurality of heating elements for printing on an adjacent media a plurality of dots each one of said plurality of heating elements having a physical characteristic based on a selected drive energy level of at least one adjacent heating element;

a source of drive pulses for operating respective heating elements, each drive pulse being modulated to provide a first period of the drive pulse to not energize the respective heating element and a second period of the drive pulse to energize the respective heating element, the first and second periods together defining the selected drive energy level; and a memory for storing binary representations of each drive pulse, the binary representations having a first value representative of a drive energy level insufficient to operate the respective heating element to print on the media and a second value representative of a drive energy level sufficient to operate the respective heating element to print on the media, the binary representations having the first value being stored in the memory to represent the first period of the drive pulse and the binary representations having the second value being stored in the memory to represent the second period of the drive pulse.

2. The thermal printer of claim 1 wherein the second period follows the first period and together comprise essentially the entire drive pulse length.

3. The thermal primer of claim 1 including a measuring circuit for measuring a heating factor of each heating element and for generating a correction factor data for each heating element, and a memory for storing the correction factor data.

4. The thermal primer of claim 3 further including means responsive to the correction factor data to alter the first and second periods to reduce variations in dot size due to differences in the heating factors of the heating elements.

5. The thermal primer of claim 4 wherein the correction factor data comprise a multiplicative factor and the means responsive to the correction factor multiplies the binary representations of a drive pulse by the multiplicative factor.

6. The thermal primer of claim 4 wherein the correction factor data comprise an additive adjustment factor and the means responsive to the correction factor adds the additive correction factor to the binary representations of a drive pulse.

7. The thermal printer of claim 3 wherein the correction factor data comprise binary representations having the second value and the memory storing the correction factor data is the memory storing the binary representations of each drive pulse, the memory concatenating the correction factor data and the binary representations of the second value to lengthen the effective duration of the second period and shorten the effective duration of the first period to reduce variations in dot size due to differences in the heating factors of the heating elements.

8. The thermal printer of claim 3 wherein the measuring circuit includes:

a charge storage device;

a charge circuit operable in a first charge mode to charge the charge storage device with a charge representative of a leakage current of the thermal print head and operable in a second charge mode to provide a signal to the charge storage device representative of a load current of a selected heating element and the leakage current; and an output circuit connected to the charge storage device to provide an output signal representative of the load current.

9. The thermal printer of claim 8 wherein the charge storage device is a capacitor and the output circuit is connected to one side of the capacitor, the charge circuit including:

a source of regulated measurement voltage selectively connected to the selected heating element;

a measuring impedance having a first side connected to the selected heating element and a second side connected to a second side of the capacitor; and a print head drive control selectively connecting the selected heating element to the source of regulated measurement voltage so that in the first charge mode the print head drive control does not operate the selected heating element and in the second charge mode the print head drive control operates the selected heating element with the source of regulated measurement voltage.

10. The thermal printer of claim 9 where the source of regulated measurement voltage includes an amplifier having an input and an output, the input being connected through a voltage drop to a source of high voltage, a regulating diode, a switch operable in a first switch mode to ground the input to the amplifier and operable in a second switch mode to connect the diode to the input of the amplifier to operate the amplifier to provide the regulated measurement voltage.

11. Apparatus for measuring a resistance of a selected heating element of a thermal print head having a plurality of heating elements comprising:

a charge storage device;

a charge circuit operable in a first charge mode to charge the charge storage device with a charge representative of a leakage current of the thermal print head and operable in a second charge mode to provide a signal to the charge storage device representative of a load current of the selected heating element and the leakage current; and an output circuit connected to the charge storage device to provide an output signal representative of the load current.

12. The apparatus of claim 11 wherein the charge storage device is a capacitor.

13. The apparatus of claim 12 wherein the output circuit is connected to a first side of the capacitor and the charge circuit includes:

a source of regulated measurement voltage selectively connected to the selected heating element;

a measuring impedance having a first side connected to the thermal print head and a second side connected to a second side of the capacitor; and a print head drive control selectively connecting the selected heating element to the source of regulated measurement voltage so that in the first charge mode the print head drive control does not operate the selected heating element and in the second charge mode the print head drive control operates the selected heating element with the source of regulated measurement voltage.

14. The apparatus of claim 13 where the source of regulated measurement voltage includes an amplifier having an input and an output, the input being connected through a voltage drop to a source of high voltage, a regulating diode, a switch operable in a first switch mode to ground the input to the amplifier and operable in a second switch mode to connect the diode to the input of the amplifier to operate the amplifier to provide the regulated measurement voltage.

15. The apparatus of claim 14 including a second switch selectively connecting a source of low voltage to the first side of the capacitor.

16. The apparatus of claim 13 wherein the output circuit includes a second amplifier connected to the first side of the capacitor.

17. The apparatus of claim 16 including a second switch selectively connecting a source of low voltage to the first side of the capacitor.

18. A method of measuring a resistance of a selected heating element of a thermal print head of a thermal printer having a power source, comprising:

disconnecting a thermal print head from a power source;

providing a source of measurement voltage to a thermal print head while not operating the selected heating element to charge a charge storage device with a voltage representative of the measurement voltage and the leakage current of the print head;

operating the selected heating element with the source of measurement voltage to change the voltage on the charge storage device by an amount representative of the load current of the selected heating element; and output a signal representative of the change of voltage on the charge storage device.

19. The method of claim 18 further comprising the steps of selecting heating elements of a thermal print head in succession and repeating the steps of providing, operating and output for each heating element.

20. A thermal printer comprising:

a thermal print head having a plurality of heating elements for printing images;

a source of drive pulses for operating respective heating elements, each drive pulse having a first portion to operate the respective heating element to not energize the heating element and having a second portion to operate the respective heating element to energize the heating element;

a memory for storing the drive pulses; and a measuring circuit for measuring a heating factor of each heating element and generating a correction factor for each heating element based on the heating factor, the first and second portions being altered based on the correction factor to reduce variations in dot size due to differences in the heating factors of the heating elements.

21. The thermal printer of claim 20 wherein the correction factor comprise a multiplicative factor, and the first and second portions together form a drive pulse of fixed length, the first portion of each drive pulse is represented by a first binary value, the second portion of each drive pulse is represented by a second binary value and the correction factor is represented by a binary value, the thermal printer including means responsive to the multiplicative factor to multiply the second portion of a drive pulse by the multiplicative factor.

22. The thermal printer of claim 20 wherein the correction factor data comprise an additive adjustment factor, and the first and second portions together form a drive pulse of fixed length, the first portion of each drive pulse is represented by a first binary value, the second portion of each drive pulse is represented by a second binary value and the correction factor is represented by a binary value, the thermal printer including means responsive to the additive adjustment factor to add the additive correction factor to the second portion of a drive pulse.

23. The thermal printer of claim 20 wherein the first and second portions together form a drive pulse of fixed length, the first portion of each drive pulse is represented by a first binary value, the second portion of each drive pulse is represented by a second binary value and the correction factor is represented by a binary value, the memory being operable to concatenate the correction factor and the one portion of the drive pulse having the same binary value as the correction factor.

24. The thermal printer of claim 20 wherein the measuring circuit includes:

a charge storage device;

a charge circuit operable in a first charge mode to charge the charge storage device with a charge representative of a leakage current of the thermal print head and operable in a second charge mode to provide a signal to the charge storage device representative of a load current of the selected heating element and the leakage current; and an output circuit connected to the charge storage device to provide an output signal representative of the load current.

25. The thermal primer of claim 24 wherein the charge storage device is a capacitor and the output circuit is connected to a first side of the capacitor, the charge circuit including:

a source of regulated measurement voltage selectively connected to the selected heating element;

a measuring impedance having a first side connected to the heating element and a second side connected to a second side of the capacitor; and a print head drive control selectively connecting the selected heating element to the source of regulated measurement voltage so that in the first charge mode the print head drive control does not operate the selected heating element and in the second charge mode the print head drive control operates the selected heating element with the source of regulated measurement voltage.

26. The thermal printer of claim 25 where the source of measurement voltage includes an amplifier having an input and an output, the input being connected through a voltage drop to a source of high voltage, a regulating diode, a switch operable in a first switch mode to ground the input to the amplifier and operable in a second switch mode to connect the diode to the input of the amplifier to operate the amplifier to provide the regulated measurement voltage.

27. In a thermal printer having a thermal print head having a plurality of resistive heating elements and a power supply for supplying a load current to the heating elements, the improvement comprising:

a switch having a first power mode connecting the power supply to the thermal print head and a second power mode disconnecting the power supply from the thermal print head; and a measuring circuit having a signal circuit for providing a measurement signal, the signal circuit including an output connected to the thermal print head to provide the measurement signal to the thermal print head, and prevent means for preventing the signal circuit from sinking current from the power supply when the switch is in its first power mode, and a sense circuit connected to the signal circuit to measure an electrical current through the thermal print head when the switch is in its second power mode.

28. The apparatus of claim 27 wherein the signal circuit is a closed loop circuit and the prevent means includes a semiconductor device connected between the output and the power supply.

29. The apparatus of claim 27 wherein the prevent means is a unipolar device.

30. The apparatus of claim 27 wherein the sense circuit includes a charge storage device, and the signal circuit includes a charge circuit operable in a first charge mode to charge the charge storage device with a charge representative of a leakage current of the thermal print head and operable in a second charge mode to provide a signal to the charge storage device representative of a load current of a selected heating element and the leakage current, and an output circuit connected to the charge storage device to provide an output signal representative of the load current.

31. The apparatus of claim 30 wherein the charge storage device is a capacitor and the output circuit is connected to a first side of the capacitor, the charge circuit including a source of regulated measurement voltage connected to the thermal print head, the sense circuit including a measuring impedance having a first side connected to the thermal print head and a second side connected to a second side of the capacitor, the measuring circuit further including a print head drive control selectively connecting the selected heating element to the source of regulated measurement voltage so that in a first mode the print head drive control does not operate the selected heating element and in a second mode the print head drive control operates the selected heating element with the source of regulated measurement voltage.

32. The apparatus of claim 31 wherein the source of regulated measurement voltage includes an amplifier having an input and an output, the input being connected through a voltage drop to a source of high voltage, a regulating diode, and a switch operable in a first switch mode to ground the input to the amplifier and operable in a second switch mode to connect the diode to the input of the amplifier to operate the amplifier to provide the regulated measurement voltage.

* * * * *